US006361184B1

(12) United States Patent
Hallgrimsson et al.

(10) Patent No.: US 6,361,184 B1
(45) Date of Patent: Mar. 26, 2002

(54) LIGHTING DEVICE CONVERTIBLE BETWEEN READING LIGHT AND FLASHLIGHT CONFIGURATIONS AND HAVING SEPARATE LIGHT ACTUATING SWITCHES

(75) Inventors: Bjarki Hallgrimsson; Sarah Dobbin, both of Ottawa (CA); David Ball; Peter Altman, both of Austin, TX (US)

(73) Assignee: Lumatec Industries, Inc., Austin, TX (US)

( * ) Notice: Subject to any disclaimer, the term of this patent is extended or adjusted under 35 U.S.C. 154(b) by 0 days.

(21) Appl. No.: 09/490,977

(22) Filed: Jan. 24, 2000

(51) Int. Cl.[7] ..... F21L 4/00

(52) U.S. Cl. ..... 362/188; 362/190; 362/98; 362/191; 362/287; 362/427

(58) Field of Search ..... 362/188, 190, 362/98, 99, 191, 197, 199, 399, 400, 388, 287, 427

(56) References Cited

U.S. PATENT DOCUMENTS

| | | | | |
|---|---|---|---|---|
| 4,432,042 A | | 2/1984 | Zeller | 362/183 |
| 4,598,340 A | | 7/1986 | Dwosh et al. | 362/98 |
| 4,680,681 A | | 7/1987 | Fisherman et al. | 362/98 |
| 5,169,226 A | * | 12/1992 | Friedman | 362/190 |
| 5,203,622 A | | 4/1993 | Sottile | 362/98 |
| 5,280,416 A | | 1/1994 | Hartley et al. | 362/98 |
| 5,442,528 A | | 8/1995 | Vandenbelt | 362/98 |
| 5,695,271 A | * | 12/1997 | Zeller | 362/98 |

OTHER PUBLICATIONS

Two Sheet Containing Color Photocopies of Carton Showing Booklite by Centaur.

* cited by examiner

*Primary Examiner*—Sandra O'Shea
*Assistant Examiner*—Bertrand Zeade
(74) *Attorney, Agent, or Firm*—Flanagan & Flanagan; John R. Flanagan; John K. Flanagan

(57) ABSTRACT

A lighting device convertible between reading light and flashlight configurations has separate off/on light actuating switches. The lighting device includes a case, an elongated arm, hinge, light cap, light element, batteries, first switch and second switch. The hinge pivotally mounts a rear end of the arm to a rear end of the case to allow pivotal movement of the arm between an erect position angularly spaced from the case, the reading light configuration, and a lowered position against the main body, the flashlight configuration. The light element is mounted to the light cap which, in turn, is pivotally mounted to a front end of the arm for positioning the light element at various angles to provide light therebelow at various angles with the arm in the erect position and for positioning the light element at first and second angularly displaced positions to provide light directly forwardly of the case in the first position but not in the second position with the arm in the lowered position. The batteries are mounted within the case and are electrically connected to the light element and first and second switches. The first switch is mounted to the case and arm for switching the light element between off and on states in response to the arm being moved between the lowered and erect positions. The second switch is mounted to the case and arm for switching the light element between off and on states in response to the light cap being moved between the first and second positions with the arm in the lowered position.

20 Claims, 6 Drawing Sheets

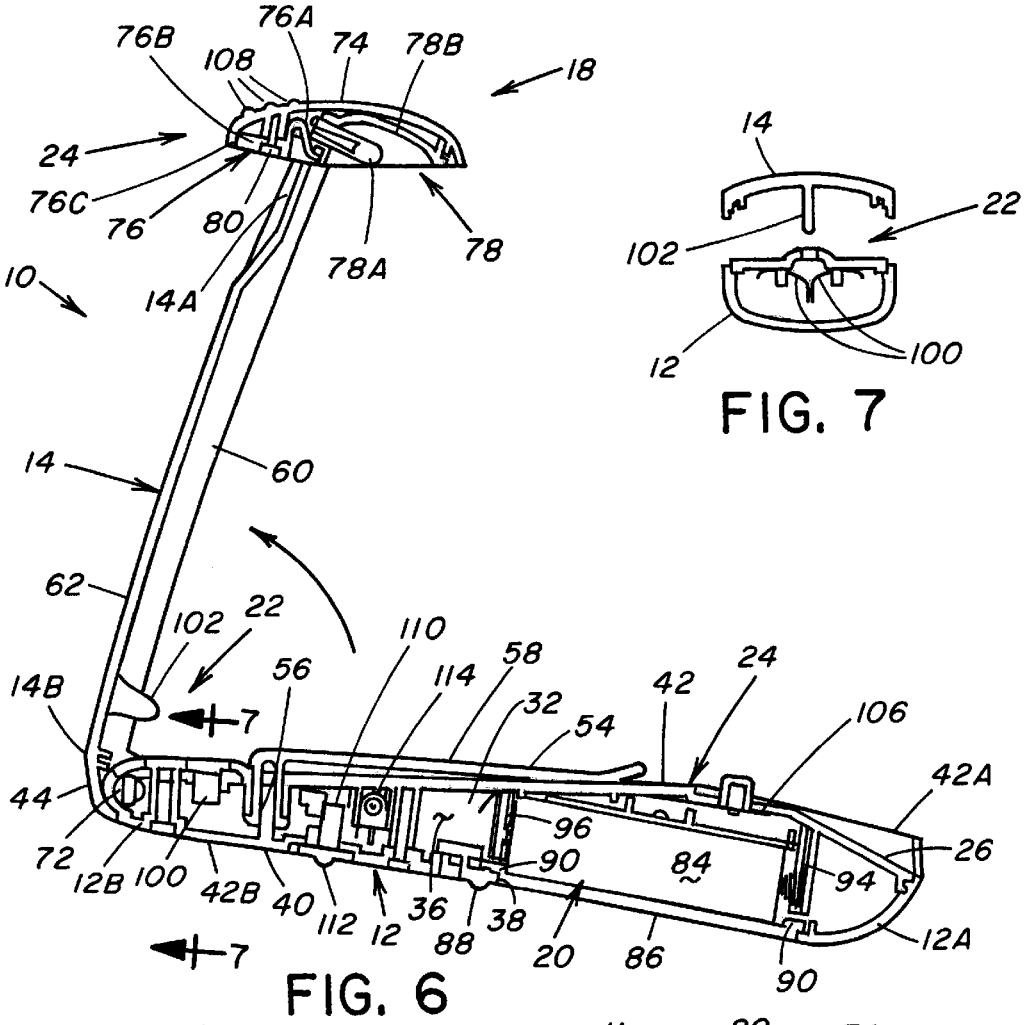
FIG. 6
FIG. 7
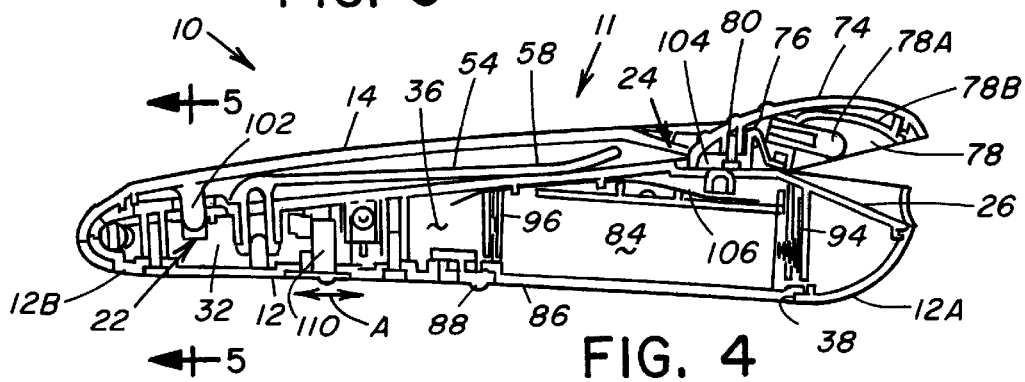
FIG. 4
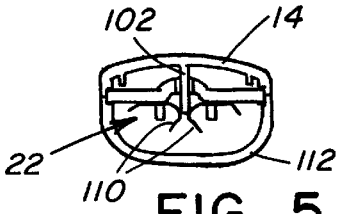
FIG. 5

LIGHTING DEVICE CONVERTIBLE BETWEEN READING LIGHT AND FLASHLIGHT CONFIGURATIONS AND HAVING SEPARATE LIGHT ACTUATING SWITCHES

CROSS REFERENCE TO RELATED APPLICATION

Reference is hereby made to a copending patent application entitled "Lighting Device Convertible Between Reading Light And Pen Light Configurations And Having Single Light Actuating Switch" by Sarah Dobbin et al, U.S. Ser. No. 09/451,176, filed Nov. 30, 1999 and assigned to the same assignee as this application.

BACKGROUND OF THE INVENTION

1. Field of the Invention

The present invention generally relates to portable lighting devices and, more particularly, is concerned with a lighting device convertible between reading light and flashlight configurations and having separate off/on light actuating switches.

2. Description of the Prior Art

Lighting devices variously configured as miniature flashlights and as book or reading lights are well known in the prior art. Examples of lighting devices which are configured as book or reading lights are disclosed in U.S. Pat. No. 4,432,042 to Zeller, U.S. Pat. No. 4,598,340 to Dwosh et al, U.S. Pat. No. 4,680,681 to Fisherman et al, U.S. Pat. No. 5,203,622 to Sottile, U.S. Pat. No. 5,280,416 to Hartley et al and U.S. Pat. No. 5,442,528 to Vandenbelt. A drawback of these and other patented prior art lighting devices is that their designs appear to restrict them to a single type of use or purpose, either as a flashlight or as a reading light. They are configured to function as one or the other, not both. This requires consumers to purchase more than one lighting device for different functions or uses which results in higher cost to them and more devices which must be carried with them.

Another portable lighting device manufactured and marketed by Centaur is promoted as being capable of use as a table light, clip-on light and book light. However, though portable the Centaur lighting device is still rather large and bulky in size and does not appear adapted to be easily carried in a user's hand as a flashlight.

Consequently, a need exists for a lighting device easily carried by a user as well as clipped to a book and having dual functionality or use, both as a flashlight and as a book or reading light, which will overcome the drawbacks of the prior art without introducing any new problems in place thereof.

SUMMARY OF THE INVENTION

The present invention provides a lighting device designed to satisfy the aforementioned need by being convertible between reading light and flashlight configurations. Further, the convertible lighting device of the present invention has separate light actuating switches for the user to operate depending upon which configuration the lighting device is in. The convertible lighting device of the present invention reduces the number of devices that must be purchased and carried by consumers to serve these two functions or uses. This results in a more cost-effective and efficient approach in fulfilling the diverse lighting needs of consumers.

Accordingly, the present invention is directed to a convertible lighting device which comprises: (a) a case having opposite front and rear ends; (b) an elongated arm having opposite front and rear ends; (c) hinge means pivotally mounting the rear end of the arm to the rear end of the case for allowing pivotal movement of the arm between an erect position angularly spaced from the case and a lowered position adjacent to the case; (d) illumination means pivotally mounted to the arm adjacent to the front end thereof for positioning the illumination means at various angles relative to the arm so as to provide light therebelow at various angles relative to the arm when the arm is in the erect position and for positioning the illumination means at first and second angularly displaced positions relative to the arm so as to provide light directly forwardly of the case in the first position but not in the second position of the illumination means when the arm is in the lowered position; (e) means for supplying power to the illumination means being mounted to the case and electrically connected to the illumination means; (f) first switch means mounted to the case and arm and connected to the power supplying means and illumination means for switching the illumination means between off and on states in response to the arm being moved between the lowered and erect positions; and (g) second switch means separate from the first switch means and being mounted to the case and arm and connected to the power supplying means and illumination means for switching the illumination means between off and on states in response to the illumination means being moved between the first and second angularly displaced positions when the arm is in the lowered position.

The case has a recess at the front end in which the illumination means is inserted and exposed when the arm is in the lowered position. The case also includes a base member and a top member. The base member has a bottom wall with opposite front and rear ends and defines a compartment in the base member and a first portion of the recess of the case at the front end of the bottom wall. The top member has a top wall with opposite front and rear ends and is fixedly mounted on the base member and encloses the compartment of the base member. The top wall of the top member at the front end defines a second portion of the recess of the case complementary to the first portion of the recess defined at the front end of the bottom wall of the base member such that the base and top members together define the recess of the case. The lighting device further includes a clip mounted to the top wall of the top member of the case for facilitating retention on an article when the arm is in the erect position. The hinge means includes a plurality of aligned holes defined through the rear ends of the arm and case, and a pair of hinge pins fitted through the holes so as to pivotally couple the arm to the case for undergoing the pivotal movement between the erect and lowered positions.

The illumination means includes a dome-shaped light cap pivotally mounted to a bifurcated portion of the front end of the arm for undergoing pivotal movement between a range of angular positions relative to the arm, a mounting element attached to and supported from an underside of the light cap, and a light generating element mounted to the mounting element and partially surrounded by the dome-shaped light cap. The lighting device further comprises a light reflecting shield mounted to the light cap adjacent to the mounting and light generating elements of the illumination means such that the light reflecting shield partially surrounds the light generating element of the illumination means and directs light downwardly therefrom when the arm is in the erect position and directs light forwardly therefrom when the arm is in the lowered position.

The first switch means includes a pair of opposite contact elements mounted to the case at the rear end thereof which make electrical contact with one another and complete an electrical circuit between the power supplying means and illumination means and turn on the illumination means in response to moving the arm to the erect position. The first switch means also includes an insulated member mounted to and protruding from the arm at the rear end thereof in alignment with the opposite contact elements such that the insulated member becomes disposed between and separates the contact elements preventing them from contacting one another and thereby interrupts the electrical circuit and turns off the illumination means in response to moving the arm to the lowered position.

The second switch means is separate from the first switch means and includes a first contact element mounted to the case adjacent to the power supplying means and a second contact element mounted to the mounting element of the illumination means. The second contact element respectively makes and breaks electrical contact with the first contact element upon pivoting the light cap of the illumination means between the first and second angularly-displaced positions of the illumination means when the arm is in the lowered position.

The present invention also is directed to a lighting device which comprises: (a) a body having opposite front and rear ends; (b) illumination means pivotally mounted to the front end of the body for positioning the illumination means at first and second angularly displaced positions relative to the front end of the body so as to provide light directly forwardly of the body in the first position but not in the second position, the illumination means including (i) a light cap pivotally mounted to the front end of the body for undergoing pivotal movement between the first and second positions, and (ii) a light element mounted to the light cap; (c) means for supplying power to the illumination means being mounted to the body and electrically connected to the light element of the illumination means; and (d) switch means mounted to the body and the illumination means and connected to the power supplying means and the illumination means for switching the illumination means between off and on states in response to the illumination means being moved between the first and second angularly displaced positions, the switch means including (i) a first contact element mounted to the body adjacent and connected to the power supplying means, and (ii) a second contact element mounted to the light cap of the illumination means and connected to the light element, the second contact element respectively making and breaking electrical contact with the first contact element in response to pivoting the light cap of the illumination means and the light element therewith between the first and second angularly-displaced positions. The body at the front end thereof defines a recess adjacent to the light element of the illumination means. The light cap is angularly displaced remote from the recess in the first position and adjacent to the recess in the second position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 4 is a longitudinal sectional view of the device of FIG. 2.

FIG. 5 is a transverse sectional view of the device taken along line 5—5 of FIG. 4.

FIG. 6 is a longitudinal sectional view of the device of FIG. 3.

FIG. 7 is a transverse sectional view of the device taken along line 7—7 of FIG. 6.

DETAILED DESCRIPTION OF THE INVENTION

Figure 1:
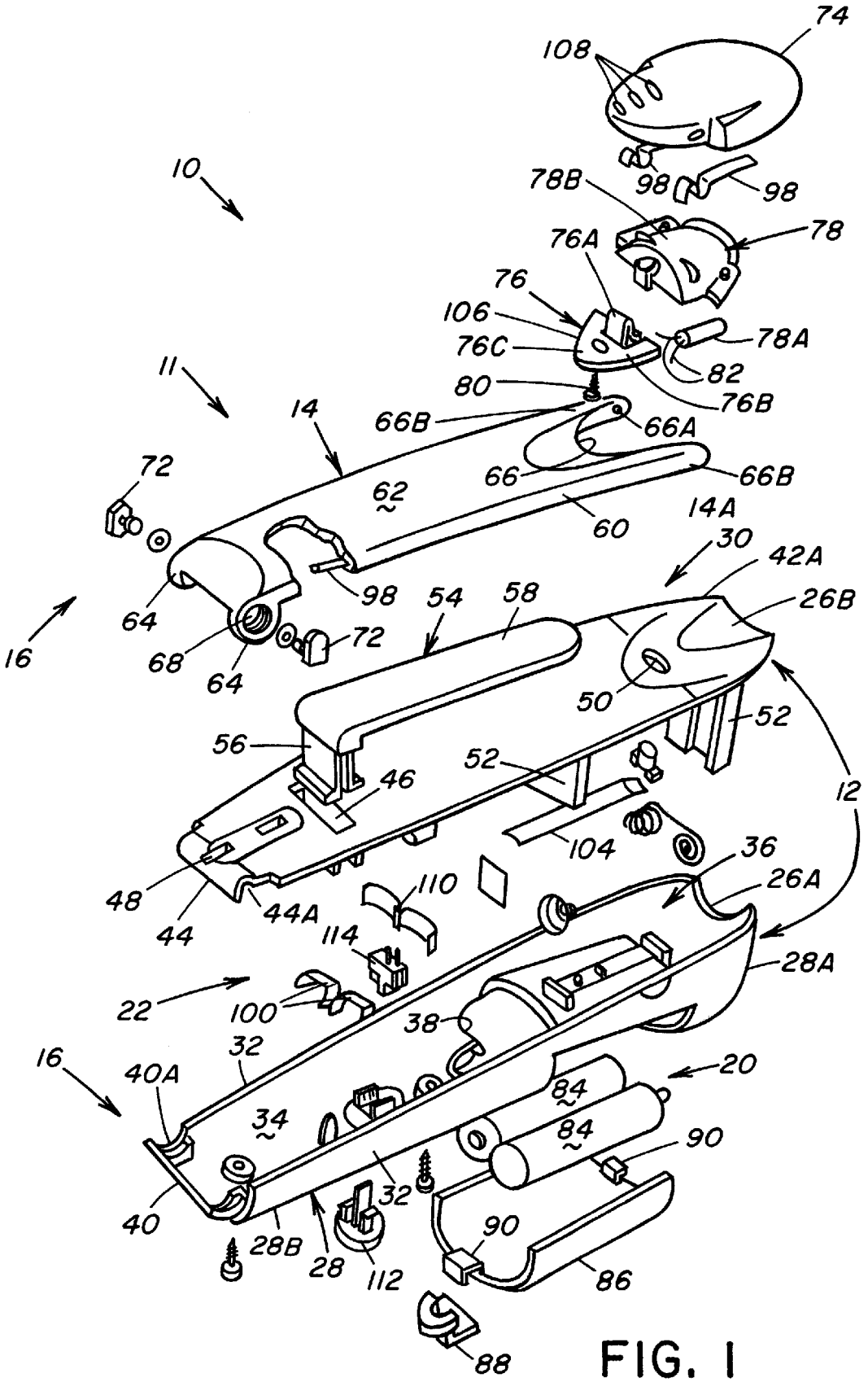
FIG. 1 is an exploded perspective view of a convertible lighting device of the present invention.
Figure 3:
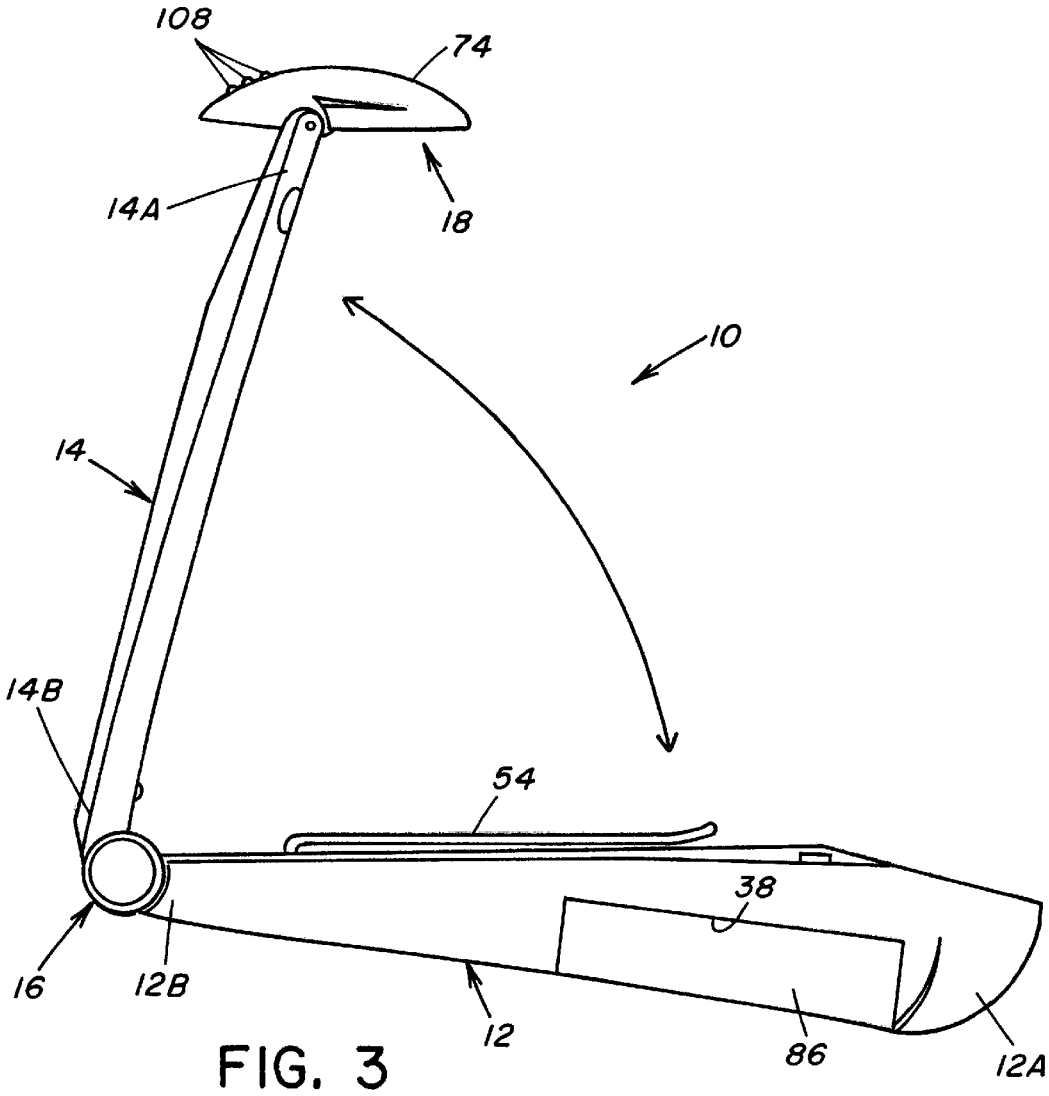
FIG. 3 is a side elevational view of the device of FIG. 1 assembled and converted to a reading light configuration.
Figure 2:
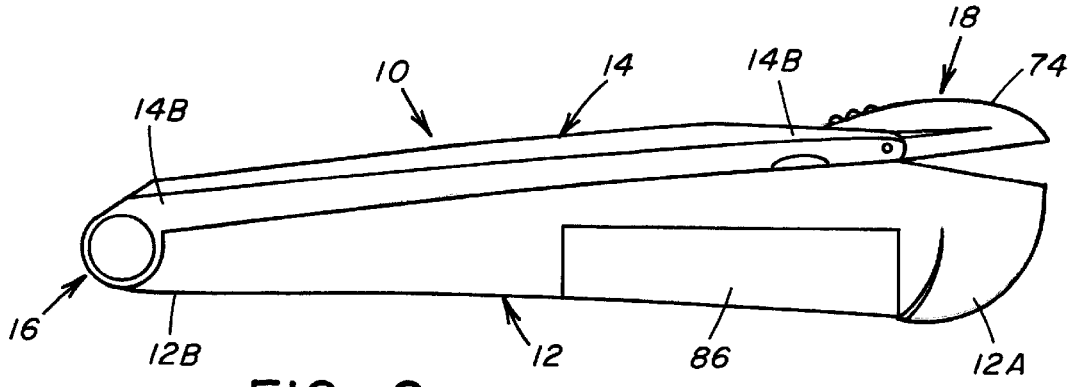
FIG. 2 is a side elevational view of the device of FIG. 1 assembled and converted to a flashlight configuration and its illumination means switch to an off state.
Figure 8:
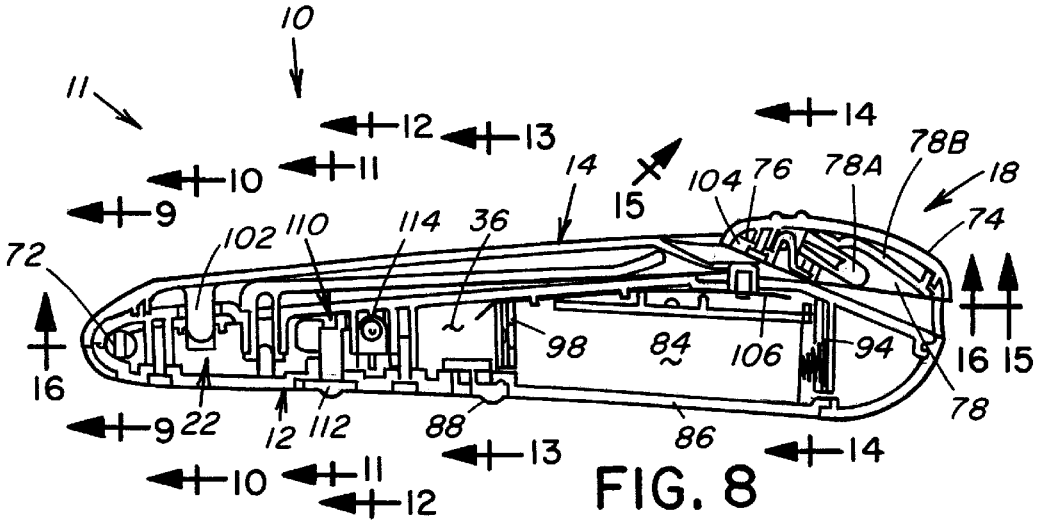
FIG. 8 is a longitudinal sectional view of the device of FIG. 2 but with its illumination means switched to an on state.

Referring to the drawings and particularly to FIGS. 1 to 5, there is illustrated a convertible lighting device, generally designated 10, of the present invention being convertible between a reading light configuration, as shown in FIG. 3, and a flashlight configuration, as shown in FIG. 2. Basically, the convertible lighting device 10 includes a body 11 having a case 12, an elongated arm 14 and hinge means 16 pivotally mounting the arm 14 to the case 12, and illumination means 18, power supplying means 20, first switch means 22 and second switch means 24. The case 12 has opposite front and rear ends 12A, 12B and defines a recess 26 at the front end 12A. The arm 14 has opposite front and rear ends 14A, 14B. The hinge means 16 pivotally mounts the rear end 14B of the arm 14 to the rear end 12B of the case 12 for allowing pivotal movement of the arm 14 between a raised or erect position angularly spaced from the case 12, being the reading light configuration of FIG. 3, and a lowered position adjacent to the case 12, being the flashlight configuration of FIG. 2. The illumination means 18 is pivotally mounted to the arm 14 adjacent to the front end 14A thereof to allow positioning of the illumination means 18 at various angles relative to the arm 14 so as to provide light therebelow at various angles relative to the arm 14 when the arm 14 is in the erect position. The pivotal mounting of the illumination means 18 also allows positioning of the illumination means 18 at first and second angularly displaced positions (respectively seen in FIGS. 2 and 8) relative to the arm 14 so as to provide light directly forwardly of the case 12 in the first position but not in the second position of the illumination means 18 when the arm 14 is in the lowered position. The power supplying means 20 is mounted to the case 12 and is electrically connected to the illumination means 18 for supplying electrical power to the illumination means 18. The first switch means 22 is mounted to the case 12 and arm 14 and connected to the power supplying means 20 and illumination means 18 for switching the illumination means 18 between off and on states in response to the arm 14 being moved between the lowered and erect positions. The second switch means 24 is separate from the first switch means 22 and is mounted to the case 12 and the arm 14 and connected to the power supplying means 20 and illumination means 18 for switching the illumination means 18 between off and on states in response to the illumination means 18 being moved between the first and second angularly displaced positions when the arm 14 is in the lowered position.

Referring now to FIGS. 1 to 15, the case 12 of the lighting device 10 includes a base member 28 and a cover or top member 30. The base member 28 of the case 12 has opposite front and rear ends 28A, 28B and elongated opposite side walls 32 which are continuous with one another around the front and rear ends 28A, 28B of the base member 28 and an elongated bottom wall 34 extending between and interconnecting the opposite side walls 32 so as to provide the base member 28 with a substantially curved, U-shaped or semi-cylindrical configuration, though it may have any other suitable shape. The side walls 32 and bottom wall 34 of the base member 28 defines a compartment 36 therewithin and a first portion 26A of the recess 26 of the case 12 at the front end 28A of the base member 28. Further, the compartment 36 extends substantially the entire length of the base member 28, though need not be so limited.

The base member 28 of the case 12 also has an opening 38 defined substantially in the bottom wall 34 thereof and partially extends into the opposite side walls 32. The opening 38 is disposed in the bottom wall 34 symmetrically along a longitudinal centerline of the bottom wall 34 closer to the front end 28A than to the rear end 28B of the base member 28, though need not be so limited. The opening 38 is a cutout of the bottom wall 34 and so has a configuration substantially similar to the configuration of the bottom wall 34, but appears to have a substantially rectangular configuration in a top plan view. The opening 38 leads into the compartment 36 and must be of a size large enough to fit one or more conventional AA batteries therethrough, though may otherwise have any other suitable shape and size. The base member 28 also has a mounting portion 40 formed at the rear end 28B of the base member 28. The mounting portion 40 defines a pair of semi-circular recesses 40A in the opposite side walls 32 at the rear end 28B of the base member 28.

The top member 30 of the case 12 has a top wall 42 with opposite front and rear ends 42A, 42B and is fixedly mounted on and encloses the compartment 36 of the base member 28. The top wall 42 of the top member 30 at the front end 42A thereof defines a second portion 26B of the recess 26 of the main body 12 complementary to the first portion 26A of the recess 26 defined by the base member 28 such that the base and top members 28, 30 together define the recess 26 of the case 12. The portion 26B of the recess 26 defined by the top wall 42 has a substantially curved configuration which converges rearwardly from the front end 42A to a point spaced interiorly from the front end 42A, though it may have any other suitable shape. The remainder of the top wall 42 of the top member 30 has a substantially flat configuration, though it may have any other suitable shape.

The top member 30 of the case 12 also has a mounting portion 44 formed at the rear end 42B of the top wall 42. The mounting portion 44 defines a pair of opposite semi-circular recesses 44A at the rear end 42B. The pairs of semi-circular recesses 40A, 44A combine to form a pair of substantially circular holes 46 at the rear end 12B of the case 12 when the top member 30 is fixedly mounted to the base member 28.

The top member 30 also defines a transverse slot 46, a longitudinal slot 48 and an opening 50. The transverse slot 46 is spaced inwardly from the opposite sides 42C of the top wall 42 and disposed closer to the rear end 42B than to the front end 42A thereof. The transverse slot 46 has a longitudinal width less than its transverse length. The longitudinal slot 48 is spaced inwardly from the opposite sides 42C and disposed closer to the rear end 42B than to the front end 42A of the top wall 42 and between the transverse slot 46 and the rear end 42B of the top wall 42. The longitudinal slot 48 has a transverse width less than its longitudinal length. The longitudinal slot 48 is smaller than the transverse slot 46, though need not be so limited. The opening 50 is spaced inwardly from the opposite sides 30C and disposed closer to the front end 42A than to the rear end 42B of the top wall 42. The opening 50 is spaced from the recess 26 but disposed closer to the recess 26 than to the transverse slot 46. The opening 50 has a circular configuration, though may have any other suitable shape.

The top member 30 of the case 12 also has a pair of partitions 52 spaced from one another along the longitudinal centerline of the top wall 42 and extends in substantially parallel relation to the other downwardly from the underside of the top wall 42 of the top member 30. While the partitions 52 extend in substantially perpendicular relation to the top member 30, they need not be so limited. A forward one of the partitions 52 is disposed closer to the front end 42A of the top wall 42 than a rearward one of the partitions 52 although both are disposed closer to the front end 42A than to the rear end 42B of the top wall 42. Each partition 52 has a substantially rectangular configuration, though it may have any other suitable shape. Each partition 52 also has a height approximately similar to a distance between the bottom wall 34 of the base member 28 and the top wall 42 of the top member 30 when the top member 30 and base member 28 are fixedly mounted to one another. Each partition 52 further extends between the opposite sides 42C of the top wall 42. The partitions 52 are positioned along the longitudinal centerline of the top member 30 on opposite sides of the opening 38 in the base member 28 when the top member 30 is mounted to the base member 28 and such that a portion of the compartment 36 directly above the opening 38 is separated from the rest of the compartment 36.

The lighting device 10 further includes a clip 54 mounted to the top wall 42 of the top member 30 of the case 12. The clip 54 has an upside down T-shaped end portion 56 disposed within the compartment 36 of the case 12 and extending therefrom through the transverse slot 46 to above and along the top wall 42 of the top member 30 of the case 12. The clip 54 curves forwardly from the end portion 56 into a generally straight portion 58 to an opposite end above the top wall 42 of the top member 30 by which the clip 54 is available for use in temporarily attaching the lighting device 10 to a book or magazine for use when the arm 14 is in the erect position. The clip 54 is covered and hidden by the arm 14 when the latter is at the lowered position adjacent to the case 12 of the lighting device 10.

The arm 14 of the lighting device 10 has elongated opposite side walls 60, a top wall 62 extending between and interconnecting the opposite side walls 60, and a pair of opposite tabs 64 formed on the opposite side walls 60 at the rear end 14B of the arm 14. The top wall 62 has a generally flat configuration, though may have any other suitable shape. The arm 14 has a length and width substantially the same as the length and width of the case 12. The tabs 64 have substantially semicircular configurations, though may have any other suitable shape, and extends downwardly from the opposite side walls 60. The front end 14A of the arm 14 defines a concave-shaped bifurcated portion 66 that overlies the recess 26 at the front end 12A of the case 12 and pivotally supports the illumination means 18.

The hinge means 16 of the lighting device 10 includes a plurality of aligned holes 68, 70 and a pair of hinge pins 72. The holes 68, 70 are four in number, though may be of any other suitable number. A pair of the holes 68 are defined at the rear end 14B of the arm 14 through the opposite tabs 64 thereon and another pair of the holes 70 are defined at the rear end 12B of the case 12 through the opposite sides of the mounting portions 40, 44 of the base and top members 28, 30 being respectively defined by the semi-circular recesses 40A, 44A thereof when the base and top members 28, 30 are fixedly attached to one another. The holes 68, 70 have substantially circular configurations and receive the hinge pins 72 of similar configurations therethrough. One of the hinge pins 72 fits through the one hole 68 in one of the tabs 64 of the arm 14 and through the adjacent hole 70 of the case 12. The other of the hinge pins 72 fits through the other hole 68 in the other of the tabs 64 of the arm 14 and through the adjacent hole 70 of the case 12. The hinge pins 72 so fitted and retained through the aligned holes 68, 70 pivotally mount the arm 14 to the case 12 to undergo pivotal movement between the erect and lowered positions.

Figure 20:
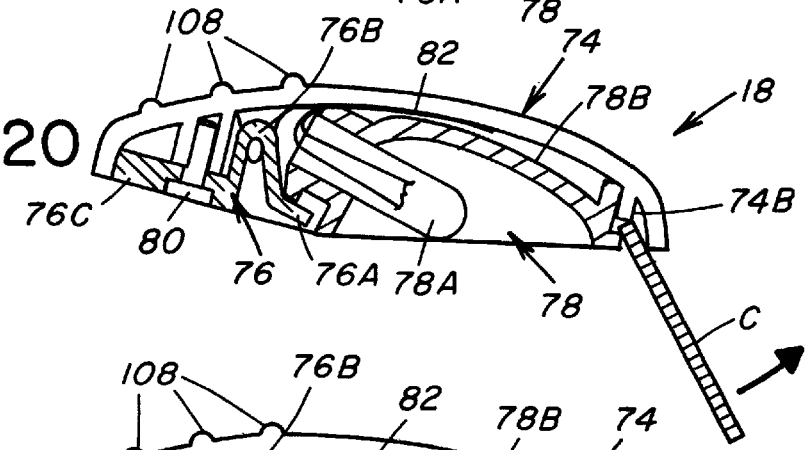
Figure 21:
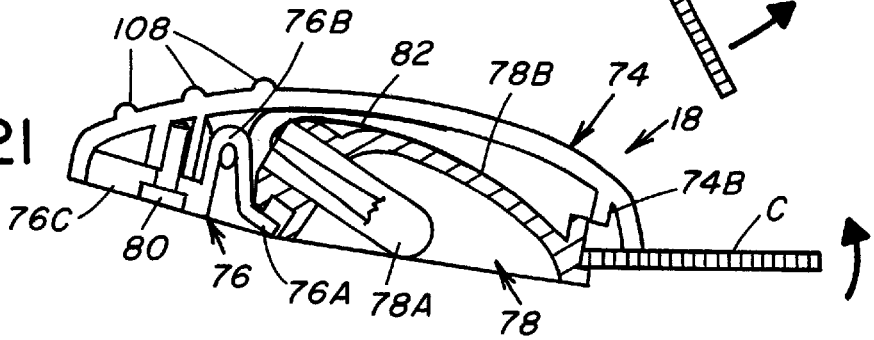

Referring to FIGS. 1, 4, 6, 15 and 17 to 21, the illumination means 18 of the lighting device 10 includes a dome-shaped light cap 74, a mounting element 76 and a light generating means in the form of a light cartridge 78 having a light bulb 78A. The light cap 74 is pivotally mounted at 74A to the bifurcated portion 66 of the front end 14A of the arm 14 for undergoing pivotal movement between a range of angular positions relative to the arm 14. The mounting element 76 is attached to and supported from an underside of the light cap 74. The light cartridge 78 is mounted to the mounting element 76 and also partially surrounded by the dome-shaped light cap 74. More particularly, the mounting element 76 has a forward portion 76A of a substantially inverted V-shaped configuration in longitudinal cross-section, though may have any other suitable shape, a middle portion 76B receiving therethrough a mounting screw 80 which threads into the light cap 74, and a rearward portion 76C which is disposed within the bifurcated end portion 66 of the arm 14 and is in the form of a generally flat plate. The forward portion 76A of the mounting element 76 receives a pair of leads 82 of the light bulb 78A so as to electrically connect the bulb 78A to the second switch means 24. The light bulb 78A may be of any conventional type and have a lens focusing element for generating a relatively intense light beam. The light cartridge 78 further includes a light reflecting shield 78B mounted to the underside of the light cap 74 adjacent to the mounting element 76 and light bulb 78A of the illumination means 18 such that the light reflecting shield 78B partially surrounds the light bulb 78A and directs light downwardly therefrom when the arm 14 is in the erect position and directs light forwardly therefrom when the arm 14 is in the lowered position. The light reflecting shield 78B has a generally inverted U-shaped configuration, though may have any other suitable shape. The light cartridge 78 is insertable into and removable from the light cap 74 in the manner shown in FIGS. 17 to 21. A snap fit relationship is formed between the light cartridge 78 and an interior ledge 74B on the light cap 74 and the forward portion 76A of the mounting element 76. An edge of a coin C may be used to easily release the light cartridge 78 from the light cap 74 as shown in FIGS. 20 and 21.

The power supplying means 20 of the lighting device 10 includes at least one and, preferably, a pair of batteries 84. Each battery 84 is preferably of the AA type, but the lighting device 10 could be designed to use any other suitable type of battery. The batteries 84 are insertable into and removable from within the compartment 36 through the opening 38 in the bottom wall 34 of the base member 28 of the case 12. The batteries 84 when in the compartment 36 are disposed between the partitions 52 of the top member 30 of the case 12.

The lighting device 10 further includes a compartment door 86 and a compartment door locking member 88. The compartment door 86 is attachable to and removable from the base member 28 of the case 12 for covering and uncovering the opening 38 in the bottom wall 34 of the base member 28. The compartment door 86 has a configuration substantially similar to and a continuation of the bottom wall 34 of the base member 28, though may have any other suitable shape. The compartment door 86 has a tongue member 90 extending from one end thereof.

The compartment door locking member 88 is slidably mounted to and through the opening 38 of the bottom wall 34 of the base member 28 of the case 12 adjacent to the end of the compartment door 86 where the tongue member 90 is located such that sliding movement of the locking member 88 in one direction causes the locking member 90 to overlap an edge of the compartment door 86 preventing it from being removed from the bottom wall 34 of the base member 28 of the main body 12 whereas sliding movement of the locking member 90 in an opposite direction clears the locking member 88 from overlapping the compartment door 86 allowing it to be removed from the bottom wall 34. An outer portion 88A of the locking member 88 can be contacted by a user from outside the compartment 36 for manually sliding the locking member 88.

Figure 16:
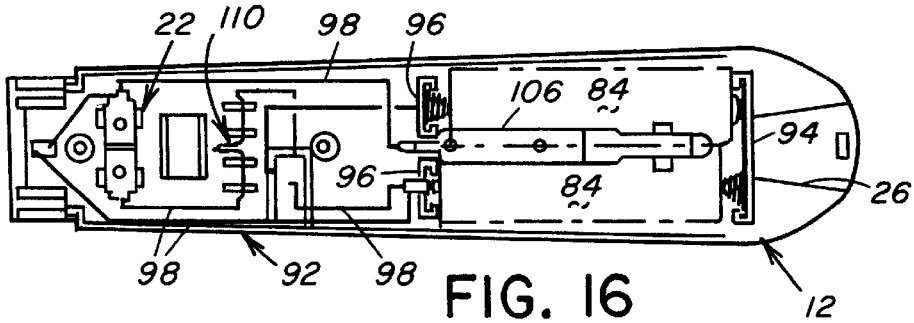
FIG. 16 is a longitudinal sectional view of the lighting device taken along line 16—16 of FIG. 8.
Figure 9:
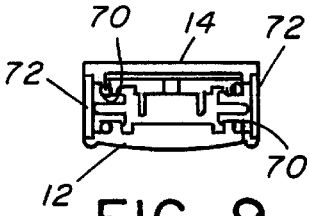
FIG. 9 is a transverse sectional view of the device taken along line 9—9 of FIG. 8 through hinge means of the device.
Figure 22:
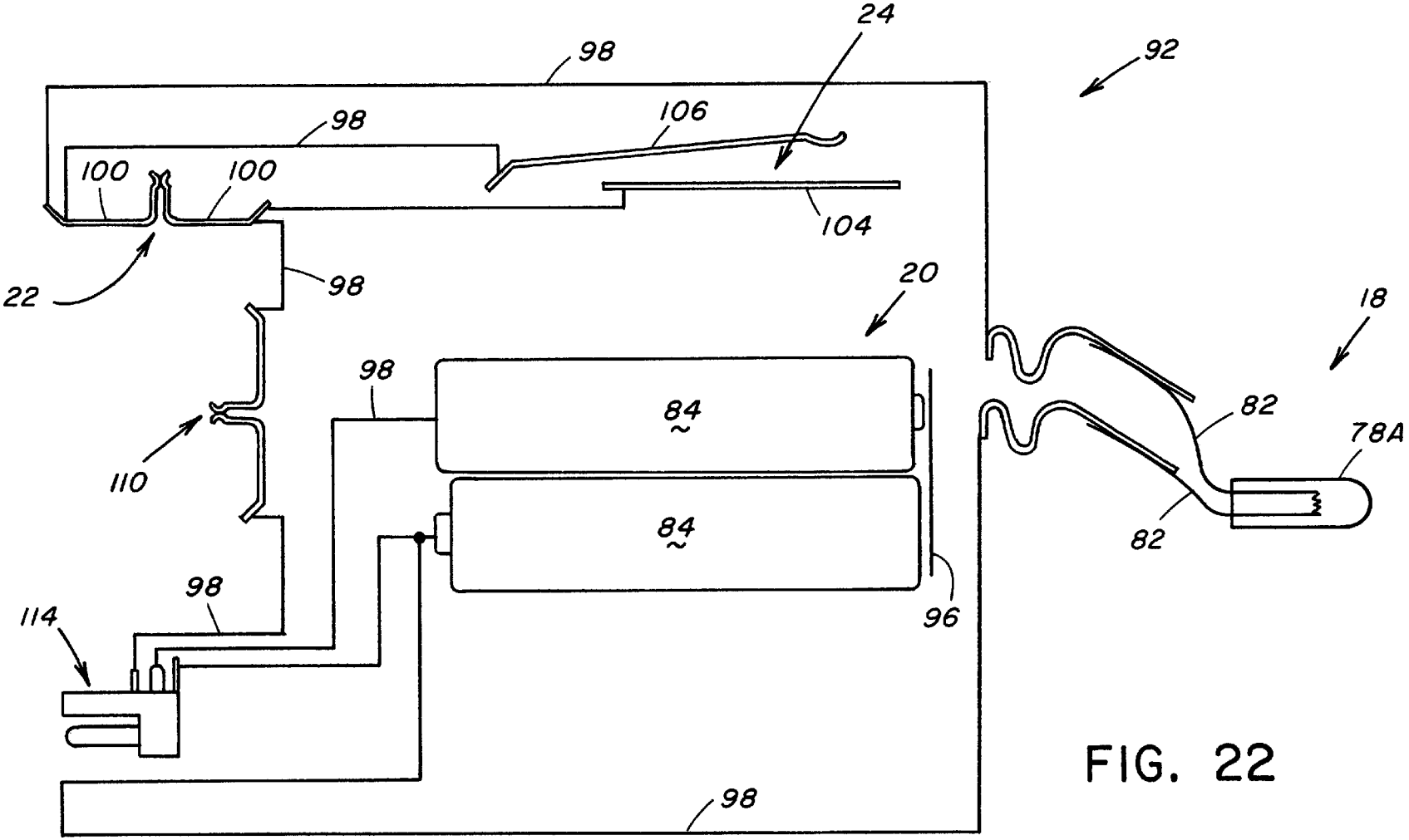
FIG. 22 is a diagrammatic view of an electrical circuit in the device incorporating first, second and main switch means, adapter jack, batteries and illumination means of the device.

Referring to FIGS. 16 and 22, the power supplying means 20 of the lighting device 10 further includes the elements required for providing an electrical circuit 92 making electrical connections between the illumination means 18, batteries 84 and first and second switch means 22, 24. These elements include first and second contact plate means 94, 96 and electrical conductors 98 made of electrically conductive material. The first and second contact plate means 94, 96 are mounted adjacent to the partitions 52, between the partitions 52 and the opposite ends of the batteries 84. The batteries 84 are disposed side by side and between and make electrical contact with the first and second contact plate means 94, 96.

The first switch means 22 of the lighting device 10 includes a pair of opposite contact elements 100 and an insulated member 102. The opposite contact elements 100 are mounted to the case 12, particularly attached on the bottom wall 34 of the base member 28 at the rear end 28B thereof and extending upwardly therefrom within the compartment 36 of the base member 28. When the arm 14 is disposed in the raised or erect position as seen in FIGS. 3 and 5, the opposite contact elements 100 are biased to make electrical contact with one another and thus complete the electrical circuit 92 formed by the batteries 84, first and second contact plates 94, 96 and electrical conductors 98 of the power supplying means 20 and the leads 82 of the light bulb 78A of the light cartridge 78 of the illumination means 18 and turn on the light bulb 78A of the light cartridge 78 of the illumination means 18. Each contact element 100 has a substantially inverted V-shaped configuration, though may have any other suitable shape, such that the contact elements 100 disposed next to one another appear to have a substantially M-shaped configuration. The light bulb 78A of the light cartridge 78 is thereby turned on automatically merely in response to the movement of the arm 14 to its raised or erect position of FIGS. 3 and 5.

The insulated member 102 of the first switch means 22 is fixedly attached to and protrudes outwardly from the underside of the top wail 62 of the arm 14 at the rear end 14B thereof. The insulated member 102 is disposed in alignment with the opposite contact elements 100 such that when the arm 14 is moved to its lowered position the insulated member 102 becomes lodged between the opposite contact elements 100 forcing them apart and causing their separation so as to prevent them from electrically contacting one another. In such manner, the insulated member 102 functions to interrupt or break the electrical circuit 92 and turn off the light bulb 78A of the light cartridge 78 of the illumination means 18 in response to arm 14 being moved into its lowered position. The insulated member 102 has a generally tapered configuration which assists its insertion between the opposite contact elements 100 upon moving the arm 14 toward the case 12 of the lighting device 10 to the lowered position.

The second switch means 24 of the lighting device 10 which is separate from the first switch means 22 is also mounted to the case 12 and arm 14 but at the front ends 12A, 14A thereof as opposed to location of the first switch means 22 at the rear ends 12B, 14B of the case 12 and arm 14. The second switch means 24 is connected in the electrical circuit 92 formed by the batteries 84, first and second contact plate means 94, 96, other electrical conductors 98 and the leads 82 of the light bulb 78A of the light cartridge 78 which is in parallel electrically with the first switch means 22. Thus, the first and second switch means 22, 24 of the electrical circuit 103 can be employed independently of one another to turn on the light bulb 78A.

Figure 10:
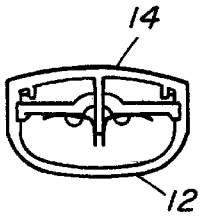
FIG. 10 is a transverse sectional view of the device taken along line 10—10 of FIG. 8 through first switch means of the device.
Figure 11:
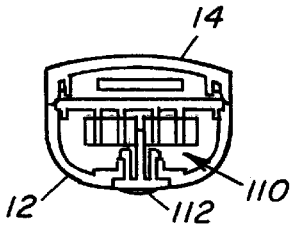
FIG. 11 is a transverse sectional view of the device taken along line 11—11 of FIG. 8 through main switch means of the device.
Figure 12:
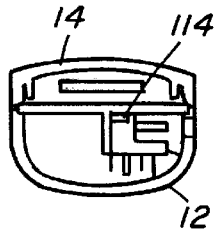
FIG. 12 is a transverse sectional view of the device taken along line 12—12 of FIG. 8 through an AC/DC adapter jack of the device.
Figure 13:
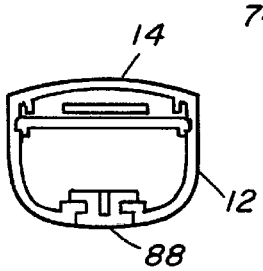
FIG. 13 is a transverse sectional view of the device taken along line 13—13 of FIG. 8 through a battery compartment door slidable locking member of the device.
Figure 14:
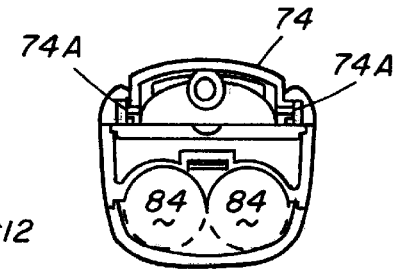
FIG. 14 is a transverse sectional view of the device taken along line 14—14 of FIG. 8 through second switch means of the device.
Figure 15:
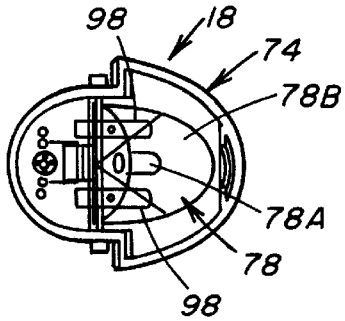
FIG. 15 is a bottom plan view of the illumination means of the device as seen along line 15—15 of FIG. 8.
Figure 17:
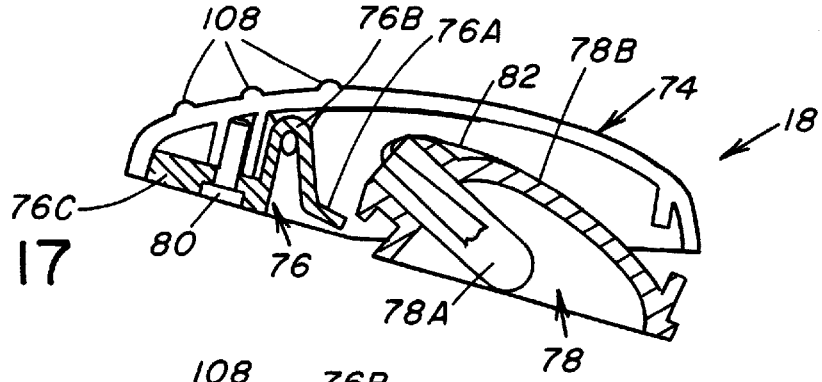
FIGS. 17 to 21 are longitudinal sectional views through the illumination means of the device showing the sequence of steps in inserting and removing a lamp cartridge into and from a light mounting cap of the device.
Figure 18:
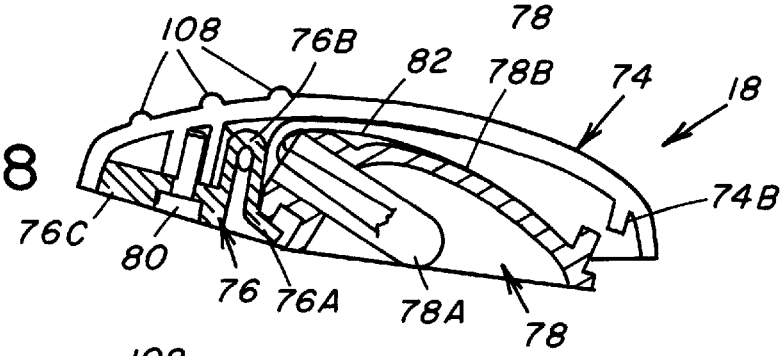
Figure 19:
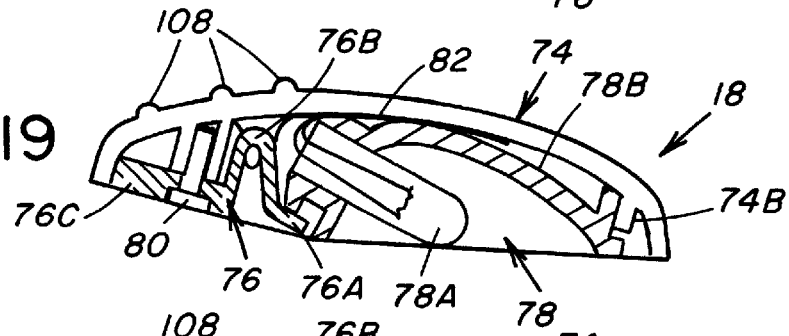

The second switch means 24 functions to switch the light-generating element 78 of the illumination means 18 between off and on states in response to the light cap 74 of the illumination means 18 being moved between the first and second angularly displaced positions, respectively seen in FIGS. 4 and 10, when the arm 14 is already in the lowered position. Particularly, the second switch means 24 includes a first contact element 104 which is disposed above the batteries 84 and connected to the electrical conductors 98 of the electrical circuit 92 and a second contact element 106 which is mounted and attached to the mounting element 76 of the illumination means 18. The second contact element 106 respectively makes and breaks electrical contact with the first contact element 104 in response to pivoting of the light cap 74 of the illumination means 18 between the first and second angularly-displaced positions when the arm 14 is in the lowered position. As can be seen in reference to FIGS. 4 and 10, the light cap 74 supports the light cartridge 78 and overlies the light bulb 78A thereof of the illumination means 18 and as explained earlier is pivotally mounted to the arm 14 so as to be movable between the first and second angularly displaced positions. In the first position of FIGS. 2 and 4, the light cap 74 is angularly displaced more remote from the front end 12A of the case 12 providing sufficient clearance therebetween that the light generated is allowed to project forwardly therefrom. On the other hand, in the second position of FIG. 8, the light bulb 78A of the light cartridge 78 is turned off and the light cap 74 substantially covers the light bulb 78A so as to protect it. The light cap 74 has one or more ridges 108 defined thereon for receiving fingers of a user at a portion which the user depresses in order to move the light cap 86 from the second to first position.

The power supplying means 20 of the lighting device 10 further includes a main switch means 110 having a switch member 112 slidably mounted on the case 12 between the first switch means 22 and an adapter jack 114. The main switch means 110 is electrically connected in the electrical circuit 92 so as to be capable of switching the entire device 10 between on and off states upon movement of the switch member 112 in the direction of arrow A. In other words, the main switch means 110 has to be switched to the on state in order for the first and second switch means 22, 24 to function as described above.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A convertible lighting device, comprising:

(a) a case having opposite front and rear ends;

(b) an elongated arm having opposite front and rear ends;

(c) hinge means pivotally mounting said rear end of said arm to said rear end of said case for allowing pivotal movement of said arm between an erect position angularly spaced from said case and a lowered position adjacent to said case;

(d) illumination means pivotally mounted to said arm adjacent to said front end thereof for positioning said illumination means at various angles relative to said arm so as to provide light therebelow at various angles relative to said arm when said arm is in said erect position and for positioning said illumination means at first and second angularly displaced positions relative to said arm so as to provide light directly forwardly of said case in said first position but not in said second position of said illumination means when said arm is in said lowered position;

(e) means for supplying power to said illumination means being mounted to said case and electrically connected to said illumination means;

(f) first switch means mounted to said case and pivoting arm and connected to said power supplying means and said illumination means for switching said illumination means between off and on states in response to said arm being moved between said lowered and erect positions; and (g) second switch means separate from said first switch means and being mounted to said case and arm and connected to said power supplying means and said illumination means for switching said illumination means between off and on states in response to said illumination means being moved between said first and second angularly displaced positions when said arm is in said lowered position.

2. The device of claim 1 wherein said case has a recess at said front end in which said illumination means is inserted and exposed when said arm is in said lowered position.

3. The device of claim 1 wherein said case includes:

a base member having a bottom wall with opposite front and rear ends and defines a compartment in said base member; and a top member having a top wall with opposite front and rear ends and being mounted on said base member and enclosing said compartment of said base member.

4. The device of claim 3 further comprising:

a clip mounted to said top wall of said top member of said case for facilitating retention of said case on an object when said arm is in the erect position.

5. The device of claim 3 wherein said base member of said case has an opening defined in said bottom wall leading into said compartment in said base member.

6. The device of claim 5 further comprising:

a compartment door attachable to and removable from said bottom wall of said base member of said case for covering and uncovering said opening in said bottom wall.

7. The device of claim 1 wherein said hinge means includes:

a plurality of aligned holes defined through said rear ends of said arm and case; and a pair of hinge pins fitted through said holes so as to pivotally couple said arm to said case for undergoing the pivotal movement between said erect and lowered positions.

8. The device of claim 1 wherein said power supplying means includes at least one battery.

9. The device of claim 1 wherein said first switch means includes a pair of opposite contact elements mounted to said case at said rear end thereof for making electrical contact with one another and completing an electrical circuit between said power supplying means and said illumination means to turn on said illumination means in response to moving said arm to said erect position.

10. The device of claim 9 wherein said first switch means further includes an insulated member mounted to and protruding from said arm at said rear end thereof in alignment with said opposite contact elements such that said insulated member becomes disposed between and separates said opposite contact elements preventing said opposite contact elements from contacting one another and thereby interrupts said electrical circuit and turns off said illumination means in response to moving said arm to said lowered position.

11. The device of claim 1 wherein said illumination means includes:

a light cap pivotally mounted to said front end of said arm for undergoing pivotal movement between a range of angular positions relative to said arm;

a mounting element attached to and supported from an underside of said light cap; and a light element mounted to said mounting element and partially surrounded by said light cap.

12. The device of claim 11 further comprising:

a light reflecting shield mounted to said arm adjacent to said mounting and light elements of said illumination means such that said light reflecting shield partially surrounds said light element and directs light downwardly therefrom when said arm is in said erect position and directs forwardly therefrom when said arm is in said lowered position.

13. The device of claim 11 wherein said second switch means includes:

a first contact element mounted to said case adjacent and connected to said power supplying means; and a second contact element mounted to said mounting element of said illumination means, said second contact element respectively making and breaking electrical contact with said first contact element in response to pivoting said light cap of said illumination means between said first and second angularly-displaced positions when said arm is in said lowered position.

14. A convertible lighting device, comprising:

(a) a case having opposite front and rear ends, said case including (i) a base member having a bottom wall with opposite front and rear ends and defines a compartment in said base member and an opening in said bottom wall leading into said compartment, and (ii) a top member having a top wall with opposite front and rear ends and being mounted on said base member and enclosing said compartment of said base member;

(b) an elongated arm having opposite front and rear ends;

(c) hinge means pivotally mounting said rear end of said arm to said rear end of said case for allowing pivotal movement of said arm between an erect position angularly spaced from said case and a lowered position adjacent to said case;

(d) illumination means pivotally mounted to said arm adjacent to said front end thereof for positioning said illumination means at various angles relative to said arm so as to provide light therebelow at various angles relative to said arm when said arm is in said erect position and for positioning said illumination means at first and second angularly displaced positions relative to said arm so as to provide light directly forwardly of said case in said first position but not in said second position of said illumination means when said arm is in said lowered position, said illumination means including (i) a light cap pivotally mounted to said front end of said arm for undergoing pivotal movement between a range of angular positions relative to said arm, and (ii) a light element mounted to said light cap;

(e) means for supplying power to said illumination means being mounted to said case and electrically connected to said light element of said illumination means;

(f) first switch means mounted to said case and pivoting arm and connected to said power supplying means and said illumination means for switching said illumination means between off and on states in response to said arm being moved between said lowered and erect positions, said first switch means including (i) a pair of opposite contact elements mounted to said case at said rear end thereof for making electrical contact with one another and completing an electrical circuit between said power supplying means and said illumination means and turning on said illumination means when said arm is moved to said erect position, and (ii) an insulated member mounted to and protruding from said arm at said rear end thereof in alignment with said opposite contact elements such that said insulated member becomes disposed between and separates said opposite contact elements preventing said opposite contact elements from contacting one another and thereby interrupts said electrical circuit and turns off said illumination means in response to moving said arm to said lowered position; and (g) second switch means separate from said first switch means and being mounted to said case and arm and connected to said power supplying means and illumination means for switching said illumination means between off and on states in response to said illumination means being moved between said first and second angularly displaced positions when said arm is in said lowered position, said second switch means including (i) a first contact element mounted to said case adjacent and connected to said power supplying means, and (ii) a second contact element mounted to said light cap of said illumination means and connected to said light element, said second contact element respectively making and breaking electrical contact with said first contact element in response to pivoting said light cap of said illumination means between said first and second angularly-displaced positions when said arm is in said lowered position.

15. The device of claim 14 wherein:

said base member at said front end of said bottom wall thereof defines a first portion of a recess defined in said front end of said case for receiving said light element therein when said arm is in said lowered position; and said top member at said front end of said top wall thereof defines a second portion of said recess of said case complementary to said first portion of said recess defined at said front end of said bottom wall of said base member such that said base and top members together define said recess of said case.

16. The device of claim 14 further comprising:

a compartment door attachable to and removable from said bottom wall of said base member of said case for covering and uncovering said opening in said bottom wall.

17. The device of claim 14 wherein said hinge means includes:

a plurality of aligned holes defined through said rear ends of said arm and case; and a pair of hinge pins fitted through said holes so as to pivotally couple said arm to said case for undergoing the pivotal movement between said erect and lowered positions.

18. The device of claim 14 further comprising:

a light reflecting shield mounted to said arm adjacent to said mounting and light elements of said illumination means such that said light reflecting shield partially surrounds said light element and directs light downwardly therefrom when said arm is in said erect position and directs forwardly therefrom when said arm is in said lowered position.

19. A lighting device, comprising:

(a) a body having opposite front and rear ends;

(b) illumination means pivotally mounted to said front end of said body for positioning said illumination means at first and second angularly displaced positions relative to said front end of said body so as to provide light directly forwardly of said body in said first position but not in said second position, said illumination means including (i) a light cap pivotally mounted to said front end of said body for undergoing pivotal movement between said first and second positions, and (ii) a light element mounted to said light cap;

(c) means for supplying power to said illumination means being mounted to said body and electrically connected to said light element of said illumination means; and (d) switch means being mounted to said body and said illumination means and connected to said power supplying means and said illumination means for switching said illumination means between off and on states in response to said illumination means being moved between said first and second angularly displaced positions, said switch means including (i) a first contact element mounted to said body adjacent and connected to said power supplying means, and (ii) a second contact element mounted to said light cap of said illumination means and connected to said light element, said second contact element respectively making and breaking electrical contact with said first contact element in response to pivoting said light cap of said illumination means and said light element therewith between said first and second angularly-displaced positions.

20. The device of claim 19 wherein said body at said front end thereof defines a recess adjacent to said light element of said illumination means, said light cap being angularly displaced remote from said recess in said first position and adjacent to said recess in said second position.

* * * * *